US007803008B2

(12) United States Patent
Onuma

(10) Patent No.: US 7,803,008 B2
(45) Date of Patent: Sep. 28, 2010

(54) PRESS-CLAMPING STRUCTURE AND PRESS-CLAMPING TERMINAL

(75) Inventor: Masanori Onuma, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/261,088

(22) Filed: Oct. 30, 2008

(65) Prior Publication Data

US 2009/0137144 A1 May 28, 2009

(30) Foreign Application Priority Data

Nov. 27, 2007 (JP) ..... 2007-305697
Dec. 27, 2007 (JP) ..... 2007-337071

(51) Int. Cl.
*H01R 11/20* (2006.01)

(52) U.S. Cl. ..... 439/442; 439/877

(58) Field of Classification Search ..... 439/423, 439/442, 877
See application file for complete search history.

(56) References Cited

U.S. PATENT DOCUMENTS 3,781,459 A * 12/1973 Peek ..... 174/94 R
3,989,339 A * 11/1976 Haitmanek ..... 439/421
4,304,454 A * 12/1981 Yokota et al. ..... 439/442
4,762,062 A * 8/1988 Wanzke ..... 100/280
5,137,468 A * 8/1992 Murakami ..... 439/422
5,561,267 A * 10/1996 Fudoo et al. ..... 174/84 C
5,635,676 A * 6/1997 Piriz ..... 174/84 C
2001/0016460 A1* 8/2001 Koide ..... 439/877

FOREIGN PATENT DOCUMENTS

JP 2005-174896 A 6/2005

* cited by examiner

*Primary Examiner*—Renee Luebke
*Assistant Examiner*—Larisa Tsukerman
(74) *Attorney, Agent, or Firm*—Sughrue Mion, PLLC

(57) ABSTRACT

A press-clamping structure includes: a wire; and a press-clamping terminal which includes a conductor press-clamping portion having a generally U-shaped cross-section. The conductor press-clamping portion includes a bottom plate and a pair of conductor caulking pieces which are bent inwardly to embrace the conductor of the wire and caulk the conductor. Distal end portions of the conductor caulking pieces are bent outwardly in a opposite direction to each other. When P1 represents a point closest to the bottom plate on an area in which the outer surfaces of the conductor caulking pieces are contacted with each other, and P2 represents a point closest to the bottom plate on the distal end portion of each of the conductor caulking piece, a formula Lh<Lw is established where Lh represents a height from the point P2 to the point P1, and Lw represents a distance between the respective points P2.

7 Claims, 4 Drawing Sheets

PRESS-CLAMPING STRUCTURE AND PRESS-CLAMPING TERMINAL

BACKGROUND OF THE INVENTION

1. Technical Field

This invention relates to a press-clamping (or crimping) structure of a press-clamping terminal (or crimp-type terminal) to an electric wire, the press-clamping terminal having a conductor press-clamping portion of a generally U-shaped cross-section including a bottom plate and a pair of conductor caulking pieces which are upwardly extended respectively from opposite (right and left) side edges of the bottom plate and are bent inwardly to embrace a conductor of the wire and caulk the conductor so that the conductor is firmly attached to an upper surface of the bottom plate. The invention also relates to a press-clamping terminal suited for achieving the above press-clamping structure.

2. Background Art

Generally, a press-clamping terminal has a conductor press-clamping portion of a generally U-shaped cross-section provided at a rear end portion thereof, and further has a sheath caulking piece provided at the rear side of this conductor press-clamping portion (see, for example, JP-2005-174896). The conductor press-clamping portion of the known press-clamping terminal has a pair of conductor press-clamping pieces (also called a barrel) formed in an upstanding manner respectively on opposite (right and left) side edges of a common bottom plate of the terminal, and the pair of conductor press-clamping pieces are bent inwardly to embrace the conductor to thereby caulk the conductor so that this conductor is firmly attached to an upper surface of the bottom plate.

Generally, copper wires are used in a wire harness which is installed within an automobile, and it is difficult to use aluminum wires which are inferior in properties (physical properties) such as electrical conductivity, strength and so on, and such aluminum wires have been hardly used. In recent years, however, there has been an increasing demand for the use of aluminum wires in view of a lightweight design of a vehicle, a low fuel consumption resulting therefrom and recyclability.

In the case of using an aluminum wire, it has now been found that when a known terminal is used as it is, problems are liable to arise because of the difference in physical properties between the aluminum wire and a copper wire. For example, a conductor of the aluminum wire which is made of aluminum or an aluminum alloy is lower (smaller) in strength than a copper conductor of the copper wire, and therefore when a conductor press-clamping portion is excessively press-clamped to the conductor of the aluminum wire, a problem is liable to arise that distal end portions 3*c* of conductor caulking pieces 3*b* bottom on a terminal bottom plate 3*a* (that is, bite into the conductor 10 to come into direct contact with the terminal bottom plate 3*a* or to come excessively close to the terminal bottom plate 3*a*) as shown in FIG. 5, thus lowering a fixing force. Furthermore, that portion of the terminal which presses the aluminum or aluminum alloy conductor of the aluminum wire against the terminal bottom plate 3*a* concentrates only on the distal ends of the conductor caulking pieces 3*b*, and therefore the region (indicated by arrows in FIG. 5) where a contract load is larger is narrowed, and therefore a contact conductivity is liable to be reduced.

The inventor of the present invention has studied and analyzed the structures in which the above problems are liable to arise, and has found that the above problems are liable to occur when the following dimensional tendency is encountered. This will now be described with reference to FIG. 5.

Namely, when the two conductor caulking pieces 3*b* are bent inwardly to embrace the conductor 10, using a lower die and an upper die of a caulking jig, first, the distal end portions 3*c* of the two conductor caulking pieces 3*b*, while rubbing against each other at their outer surfaces, are moved toward the terminal bottom plate 3*a*, and then are moved generally outwardly away from each other. It has been found that in this condition, when the distance Lw between two points P2 of the distal ends of the two conductor caulking pieces 3*b* closest to the terminal bottom plate 3*a* is smaller than a height Lh from the point P2 (that is, a point midway between the two points P2) to a point P1 of contact portions of the two conductor caulking pieces 3*b* closest to the terminal bottom plate 3*a* in a direction perpendicular to the terminal bottom plate 3*a* (that is, when the relation, Lh>Lw, is provided), the above problems are liable to occur.

It is thought that the cause for this is that when the relation, Lh>Lw, is obtained, the area where the conductor 10 is pressed against the terminal bottom plate 3*a* by the distal end portions 3*c* of the conductor caulking pieces 3*b* is reduced, so that the region where a contact load between the terminal bottom plate 3*a* and the conductor 10 is larger is narrowed. It is also thought that another cause is that since the area where the conductor 10 is pressed against the terminal bottom plate 3*a* by the distal end portions 3*c* of the conductor caulking pieces 3*b* is reduced, the distance Ls between the distal end portion 3*c* of the conductor caulking piece 3*b* and the terminal bottom plate 3*a* is reduced, so that the bottoming of the conductor caulking pieces 3*b* is liable to occur. Incidentally, it has also been found that even when the relation, Lh=Lw, is obtained, the above problems can not be solved.

SUMMARY OF THE INVENTION

This invention has been made in view of the above circumstances, and an object of the invention is to provide a press-clamping structure of a press-clamping terminal to a wire, in which a force of fixing of the terminal to a conductor, as well as a contact conductive connection of the terminal to the conductor, can be enhanced. Another object is to provide a press-clamping terminal suited for achieving this press-clamping structure.

Therefore, the above objects have been achieved by a press-clamping structure of the present invention having features recited in the following configurations (1) to (6).

(1) A press-clamping structure, including:

a wire which has a conductor therein; and a press-clamping terminal which includes a conductor press-clamping portion having a generally U-shaped cross-section wherein the conductor press-clamping portion includes a bottom plate and a pair of conductor caulking pieces which are upwardly extended respectively from opposite side edges of the bottom plate and are bent inwardly to embrace the conductor of the wire and caulk the conductor so that the conductor is firmly attached to an upper surface of the bottom plate, wherein the conductor press-clamping portion is press-clamped to the conductor of the wire to be electrically connected thereto, wherein the conductor caulking pieces are bent inwardly while outer surfaces of the conductor caulking pieces are partially contacted with each other, wherein distal end portions of the conductor caulking pieces are disposed in a vicinity of the bottom plate, and are bent outwardly in a opposite direction to each other while piercing into the conductor of the wire, and wherein when P1 represents a point closest to the bottom plate on an area in which the outer surfaces of the conductor caulking pieces are contacted with each other, and P2 represents a point closest to the bottom plate on the distal end portion of each of the conductor caulking piece, a formula Lh<Lw is established where Lh represents a height from the point P2 to the point P1 in a direction perpendicular to the bottom plate, and Lw represents a distance between the points P2 lying respectively on the conductor caulking pieces.

(2) The press-clamping structure according to (1), wherein a bend starting portion is formed on an inner surface or an outer surface of each of the conductor caulking pieces in a vicinity of the distal end portion thereof, and wherein the distal end portion of each of the conductor caulking piece is bent outwardly along the bend starting portion while piercing into the conductor so that the formula is established.

(3) The press-clamping structure according to (2), wherein the bend starting portion is a straight groove formed on the inner surface of each of the conductor caulking pieces in a vicinity of the distal end portion thereof to be extended in a longitudinal direction of the press-clamping terminal.

(4) The press-clamping structure according to (3), wherein the groove extends continuously from one side edge of the conductor caulking piece to the other side edge thereof spaced from the one side edge in the longitudinal direction of the press-clamping terminal.

(5) The press-clamping structure according to (3), wherein the groove extends from a vicinity of one side edge of the conductor caulking piece to a vicinity of the other side edge thereof, spaced from the one side edge in the longitudinal direction of the press-clamping terminal, so that a non-groove portion remains between one end of the groove and the one side edge of the conductor caulking piece, while another non-groove portion remains between the other end of the groove and the other side edge of the conductor caulking piece.

(6) The press-clamping structure according to (1), wherein the wire is an aluminum wire having therein the conductor made of aluminum or an aluminum alloy.

In the press-clamping structure of the above (1), when the conductor caulking pieces are bent inwardly to embrace the conductor, the distal end portions of the conductor caulking pieces, while rubbing against each other at their outer surfaces, are moved toward the bottom plate, and then are bent outwardly away from each other in the opposite direction to each other, and pierce into the conductor of the wire. And besides, the distance Lw between the two points P2 (lying respectively on those portions of the distal ends of the two conductor caulking pieces which are the closest to the bottom plate) is larger than the height Lh from the point P2 to the point P1 (lying on that portion of the area of overlapping (or contact) of the outer surfaces of the conductor caulking pieces with each other which is the closest to the bottom plate in the direction perpendicular to the bottom plate (Lh<Lw). Therefore, the area where the conductor is pressed against the bottom plate by the distal end portions of the conductor caulking pieces is increased, and a restituting force of the conductor increases with the increase of this area, so that the distance between the distal end portion of each conductor caulking piece and the bottom plate increases.

Therefore, the region where a contact load between the bottom plate and the conductor is larger can be increased, and this contributes to the reduction of a contact resistance, and even when the conductor press-clamping portion is excessively press-clamped to the conductor, the distal end portions of the conductor caulking pieces are prevented from bottoming on the bottom plate 3*a*, thereby preventing a fixing force from being reduced. Furthermore, the outwardly-bent distal end portions of the conductor caulking pieces serve as hooks, and therefore the spring-back of the conductor caulking pieces can be suppressed.

In the press-clamping structure of the above (2), the bend starting portion is formed on the inner surface or the outer surface of each of the conductor caulking pieces in vicinity of the distal end of the conductor caulking piece, and when each conductor caulking piece is bent inwardly to embrace the conductor, the distal end portion of the conductor caulking piece, while piercing into the conductor, is bent outwardly along the bend starting portion. Therefore, even when the conductor press-clamping portion is excessively press-clamped to the conductor, the above requirement, Lh<Lw, can be easily and highly positively satisfied.

In the press-clamping structure of the above (3), the bend starting portion is the groove formed in that portion of the inner surface of the conductor caulking piece disposed near to the distal end thereof, and extends in the longitudinal direction of the press-clamping terminal. Therefore, the distal end portion of the conductor caulking piece can be neatly bent at and along the groove in the inner surface thereof, and there is no fear that the distal end portion of the conductor caulking piece may be ruptured or broken at the groove. Furthermore, it is only necessary to additionally form the groove in the portion of the inner surface of each conductor caulking piece (of the press-clamping terminal) disposed near to the distal end thereof, and therefore these grooves can be formed simultaneously when serrations are formed in the inner surfaces of the press-clamping terminal by pressing, and therefore the processing burden hardly increases.

In the press-clamping structure of the above (4), the groove extends continuously from the one side edge of the conductor caulking piece to the other side edge thereof spaced from the one side edge in the longitudinal direction of the press-clamping terminal. Therefore, the distal end portion can be bent uniformly over its entire length from the one side edge to the other side edge.

In the press-clamping structure of the above (5), the groove extends from the vicinity of the one side edge of the conductor caulking piece to the vicinity of the other side edge thereof (spaced from the one side edge in the longitudinal direction of the press-clamping terminal) such that the non-groove portion remains between one end of the groove and the one side edge of the conductor caulking piece, while another non-groove portion remains between the other end of the groove and the other side edge of the conductor caulking piece. Therefore, the bendability of the distal end portion of each conductor caulking piece can be adjusted by changing the ratio of the length of the groove and the combined lengths of the non-groove portions.

In the press-clamping structure of the above (6), the aluminum wire is used as the wire, and therefore particularly advantageous effects can be obtained. The press-clamping structure of the above (6) (in which the force of fixing of the terminal to the aluminum wire, as well as a contact conductivity of the terminal to the aluminum wire, is enhanced) is suited for achieving a lightweight design of a vehicle and also for achieving a low fuel consumption resulting therefrom. Furthermore, this structure is suited from the viewpoint of recyclability.

The above objects have also been achieved by a press-clamping terminal of the invention having features recited in the following configurations (7) to (10).

(7) A press-clamping terminal, including:

a conductor press-clamping portion which has a generally U-shaped cross-section, and includes a bottom plate and a pair of conductor caulking pieces which is upwardly extended respectively from opposite side edges of the bottom plate and is bent inwardly to embrace a conductor of a wire to thereby caulk the conductor so that the conductor is firmly attached to an upper surface of the bottom plate; and a bend starting portion formed on an inner surface or an outer surface of each of the conductor caulking pieces in a vicinity of a distal end thereof, wherein when each conductor caulking piece is bent inwardly to embrace the conductor, the distal end portion of each conductor caulking piece, while piercing into the conductor, is bent outwardly along the bend starting portion.

(8) The press-clamping terminal according to (7), wherein the bend starting portion is a straight groove formed on the inner surface of each of the conductor caulking pieces in a vicinity of the distal end portion thereof to be extended in a longitudinal direction of the press-clamping terminal.

(9) The press-clamping terminal according to (8), wherein the groove extends continuously from one side edge of the conductor caulking piece to the other side edge thereof spaced from the one side edge in the longitudinal direction of the press-clamping terminal.

(10) The press-clamping terminal according to (8), wherein the groove extends from a vicinity of one side edge of the conductor caulking piece to a vicinity of the other side edge thereof, spaced from the one side edge in the longitudinal direction of the press-clamping terminal, so that a non-groove portion remains between one end of the groove and the one side edge of the conductor caulking piece, while another non-groove portion remains between the other end of the groove and the other side edge of the conductor caulking piece.

In the press-clamping terminal of the above (7), the bend starting portion is formed on the inner surface or the outer surface of each of the conductor caulking pieces in the vicinity of the distal end of the conductor caulking piece, and when each conductor caulking piece is bent inwardly to embrace the conductor, the distal end portion of the conductor caulking piece, while piercing into the conductor, is bent outwardly along the bend starting portion. Therefore, even when the conductor press-clamping portion is excessively press-clamped to the conductor, the distal end portion of each conductor caulking piece is bent outwardly at the bend starting portion. Therefore, even when the conductor press-clamping portion is excessively press-clamped to the conductor, the above requirement, $Lh<Lw$, in the press-clamping structure of the above (1) can be easily and highly positively satisfied, and the advantages of the press-clamping structure of the above (1) can be achieved.

In the press-clamping terminal of the above (8), the bend starting portion is the groove formed in that portion of the inner surface of the conductor caulking piece disposed near to the distal end thereof, and extends in the longitudinal direction of the press-clamping terminal. Therefore, the groove can be formed simultaneously when the serrations are formed in the inner surface of the press-clamping terminal by pressing, and therefore the processing burden hardly increases. Furthermore, the distal end portion of the conductor caulking piece can be neatly bent at and along the groove in the inner surface thereof, and there is no fear that the distal end portion of the conductor caulking piece may be ruptured or broken at the groove.

In the press-clamping terminal of the above (9), the groove extends continuously from the one side edge of the conductor caulking piece to the other side edge thereof spaced from the one side edge in the longitudinal direction of the press-clamping terminal. Therefore, the distal end portion can be bent uniformly over its entire length from the one side edge to the other side edge.

In the press-clamping terminal of the above (10), the groove extends from the vicinity of the one side edge of the conductor caulking piece to the vicinity of the other side edge thereof (spaced from the one side edge in the longitudinal direction of the press-clamping terminal) such that the non-groove portion remains between one end of the groove and the one side edge of the conductor caulking piece, while another non-groove portion remains between the other end of the groove and the other side edge of the conductor caulking piece. Therefore, the bendability of the distal end portion of each conductor caulking piece can be adjusted by changing the ratio of the length of the groove and the combined lengths of the non-groove portions.

In the present invention, the force of fixing of the terminal to the conductor, as well as the contact conductivity of the terminal to the conductor, can be enhanced.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A preferred embodiment of the present invention will now be described in detail with reference to the drawings.

Figure 1A:
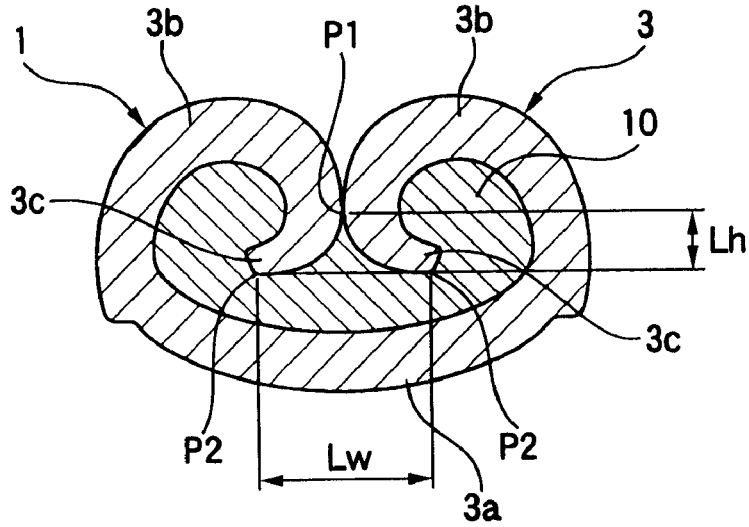
FIG. 1A is a cross-sectional view of a main part showing the construction of one preferred embodiment of a press-clamping structure of the present invention.
Figure 1B:
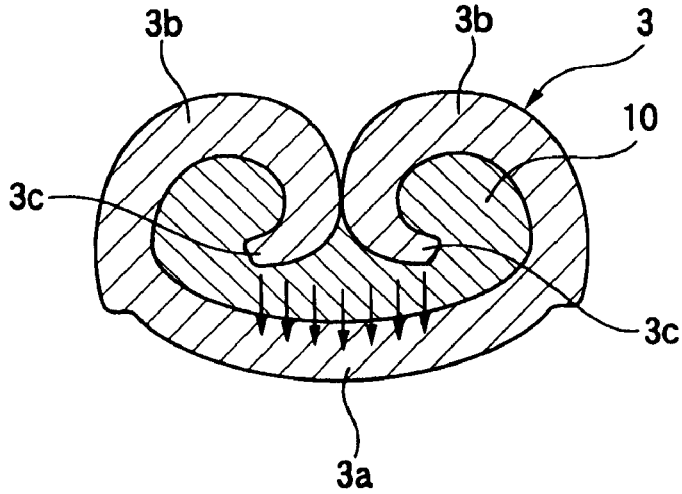
FIGS. 1B and 1C are cross-sectional views for explaining advantages of the press-clamping structure.
Figure 1C:
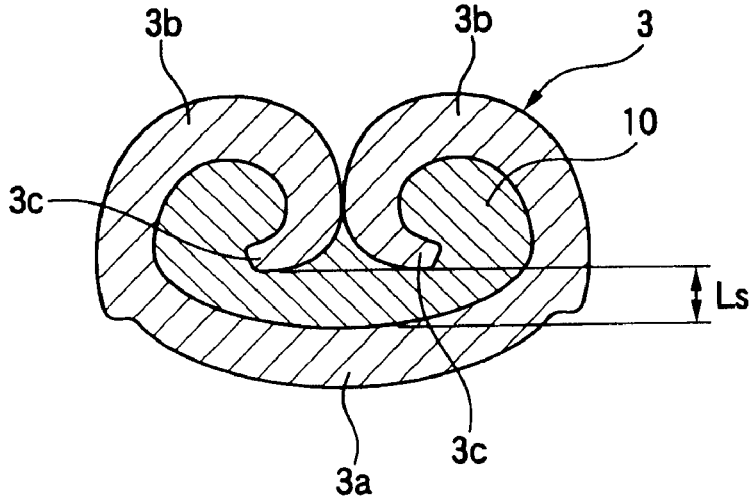
Figure 2A:
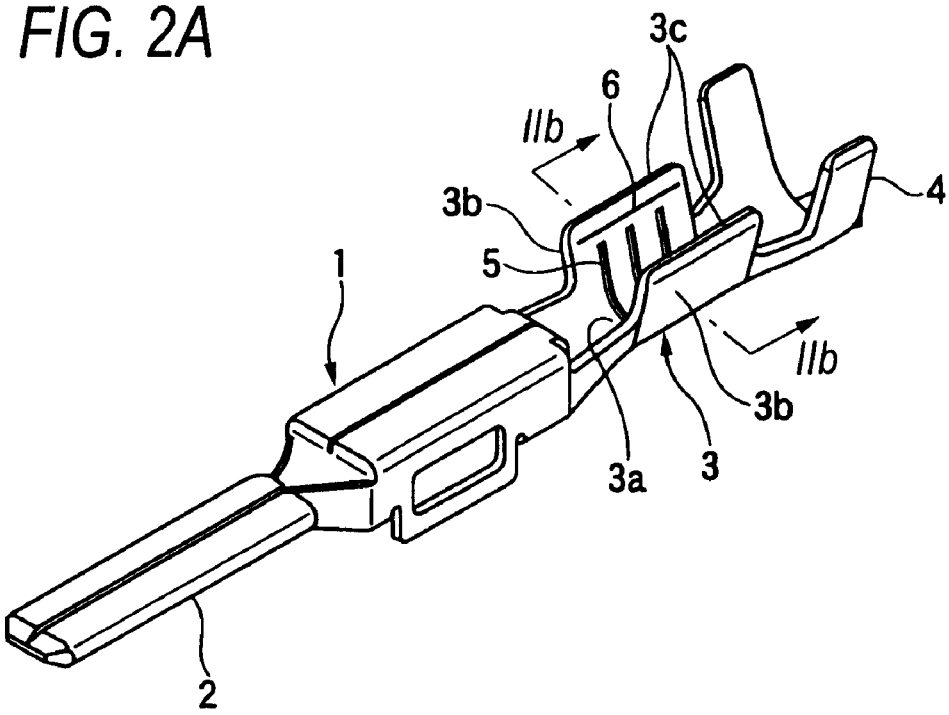
FIG. 2A is a perspective view of one preferred embodiment of a press-clamping terminal of the invention.
Figure 2B:
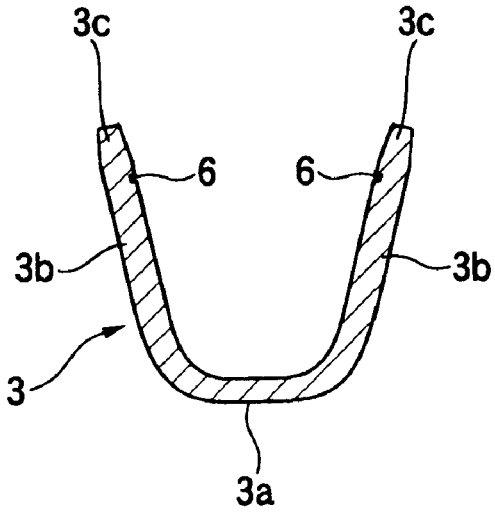
FIG. 2B is a cross-sectional view taken along the line IIb-IIb of FIG. 2A.
Figure 3A:
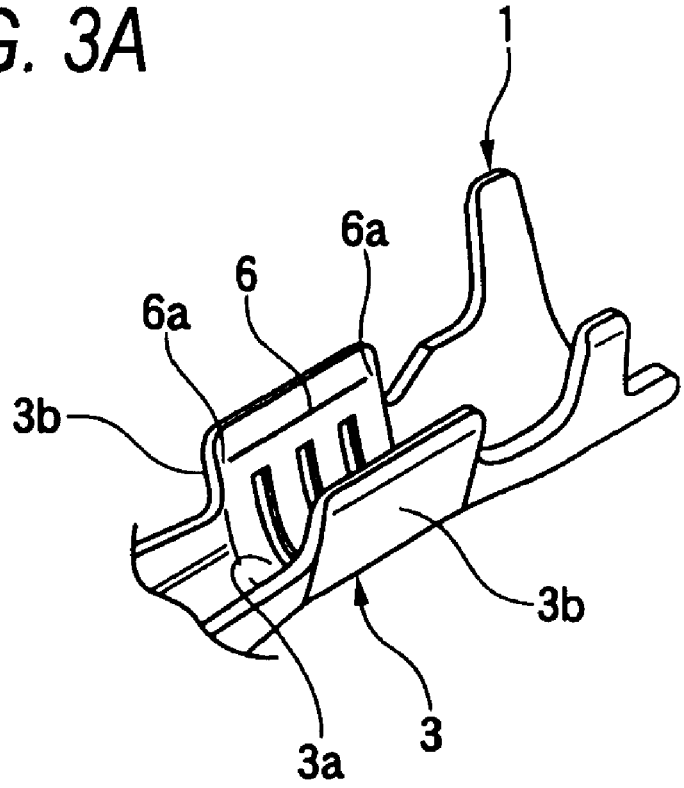
FIGS. 3A and 3B are partial perspective views showing examples of line-like grooves.
Figure 3B:
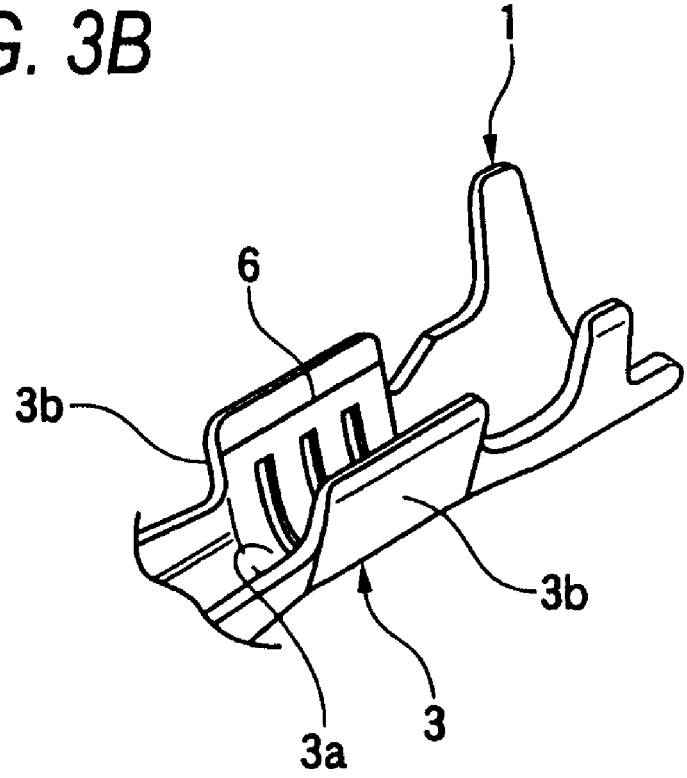
Figure 4:
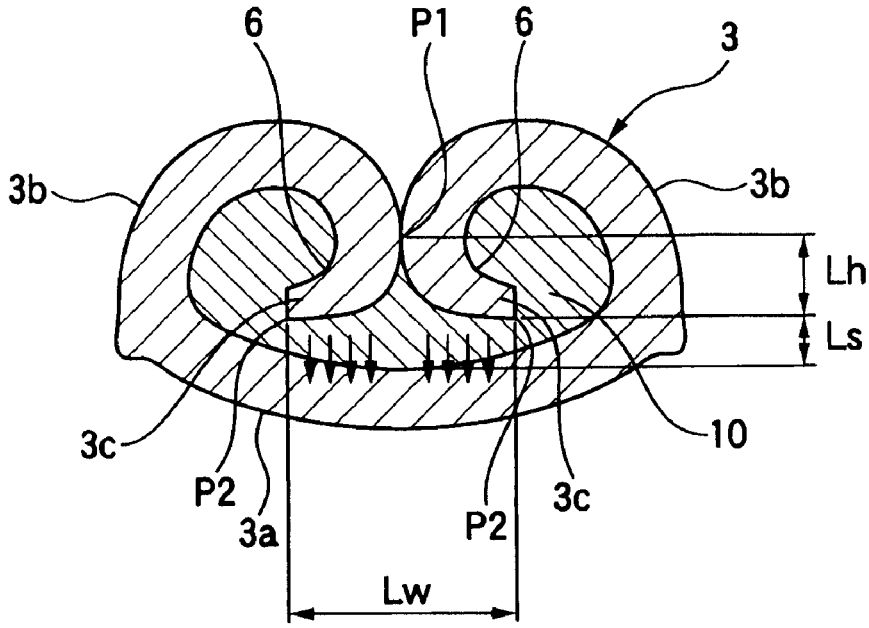
FIG. 4 is a cross-sectional view showing a condition in which the press-clamping terminal having the line-like grooves of FIG. 3A or the line-like grooves of FIG. 3B is press-clamped to a conductor.
Figure 5:
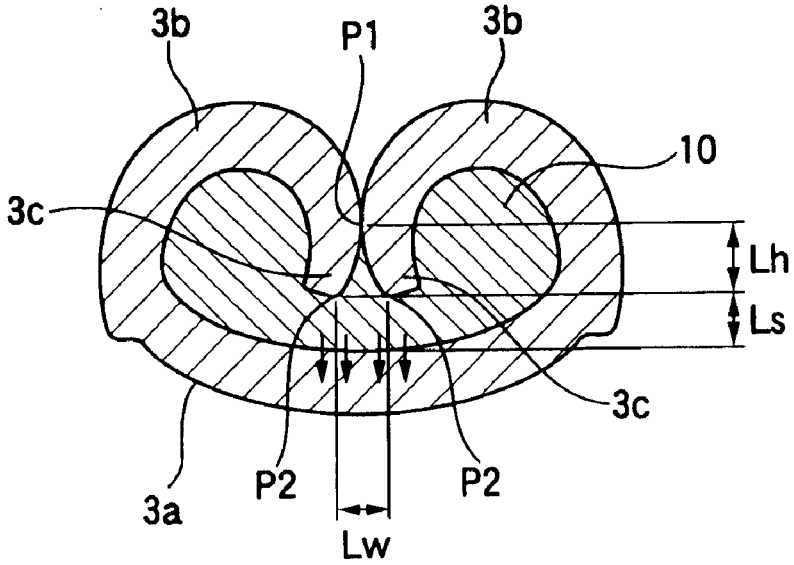
FIG. 5 is a cross-sectional view through a press-clamping portion of a known press-clamping terminal.

FIG. 1A is a cross-sectional view of a main part showing the construction of one preferred embodiment of a press-clamping structure of the invention, and FIGS. 1B and 1C are cross-sectional views for explaining advantages of the press-clamping structure. FIG. 2A is a perspective view of a press-clamping terminal suited for achieving the press-clamping structure of this embodiment, FIG. 2B is a cross-sectional view taken along the line IIb-IIb of FIG. 2A, FIGS. 3A and 3B are partial perspective views showing examples of line-like grooves, and FIG. 4 is a cross-sectional view showing a condition in which the press-clamping terminal having the line-like grooves of FIG. 3A or the line-like grooves of FIG. 3B is press-clamped to a conductor.

The press-clamping structure shown in FIG. 1A is formed by caulking a conductor press-clamping portion 3 of the press-clamping terminal 1 (shown as an example in FIG. 2A) to a conductor 10. The conductor press-clamping portion 3 has a generally U-shaped cross-section, and includes a terminal bottom plate 3*a*, and a pair of conductor caulking pieces 3*b* which are upwardly extended respectively from opposite (right and left) side edges of the terminal bottom plate 3*a* and are bent inwardly to embrace the conductor 10 of the wire (to which the terminal 1 is to be connected) to thereby caulk the conductor 10 so that this conductor 10 is firmly attached to an upper surface of the terminal bottom plate 3*a*. The wire used here is an aluminum wire, and the conductor 10 is made of aluminum.

When the right and left conductor caulking pieces 3*b* are bent inwardly to embrace the conductor 10 of the wire, first, distal end portions 3*c* of the two conductor caulking pieces 3*b*, while rubbing against each other at their outer surfaces, are moved toward the terminal bottom plate 3*a*, and then are bent outwardly away from each other in a direction of juxtaposition of the conductor caulking pieces 3*b* (that is, in a right-left direction or in an opposite direction to each other), and bite into the conductor 10 of the wire.

When P1 represents a point lying on that portion of the area of overlapping (that is, contact) of the outer surfaces of the two conductor caulking pieces 3*b* with each other which is the closest to the terminal bottom plate 3*a*, and P2 represents a point lying on that portion (which is substantially a corner portion) of the distal end of each conductor caulking piece 3*b* which is the closest to the terminal bottom plate 3*a*, the following formula (A) is established:

$$Lh<Lw \quad (A)$$

where Lh represents a height from the point P2 to the point P1 in a direction perpendicular to the terminal bottom plate 3*a*, and Lw represents the distance between the two points P2 lying respectively on the two conductor caulking pieces 3*b*.

In this press-clamping structure, the above formula (A) is established, and therefore the area where the conductor 10 is pressed against the terminal bottom plate 3*a* by the distal end portions 3*c* of the conductor caulking pieces 3*b* (that is, the area on which a force indicated by arrows in FIG. 1B acts) is increased as shown in FIG. 1B. And besides, a restituting force of the conductor 10 of the wire increases with the increase of this area, so that the distance Ls between the distal end portion 3*c* of each conductor caulking piece 3*b* and the bottom plate 3*a* increases as shown in FIG. 1C.

Therefore, the region where a contact load between the terminal bottom plate 3*a* and the conductor 10 of the wire is larger can be increased, and this contributes to the reduction of a contact resistance, and even when the conductor press-clamping portion 3 is excessively press-clamped to the conductor 10, the distal end portions 3*c* of the conductor caulking pieces 3*b* are prevented from bottoming on the terminal bottom plate 3*a*, thereby preventing a fixing force from being reduced. Furthermore, the outwardly-bent distal end portions 3*c* of the conductor caulking pieces 3*b* serve as hooks, and therefore the spring-back of the conductor caulking pieces 3*b* can be suppressed.

Next, examples of press-clamping terminals suited for achieving the press-clamping structure of FIGS. 1A to 1C will be described with reference to FIGS. 2A to 4.

As shown in FIG. 2A, this press-clamping terminal 1 includes a terminal connection portion 2 formed at its front end portion (in a longitudinal direction) and adapted to contact a mating terminal to be electrically connected thereto. This press-clamping terminal 1 further includes a conductor press-clamping portion 3 formed at its rear end portion (in the longitudinal direction) and adapted to be press-clamped to a conductor of a wire exposed by removing a sheath from the wire, and a sheath caulking portion 4 formed rearwardly of the conductor press-clamping portion 3 and adapted to be caulked onto the sheath of the wire.

The conductor press-clamping portion 3 has a generally U-shaped cross-section as best shown in FIG. 2B, and includes a terminal bottom plate 3*a*, and a pair of conductor caulking pieces 3*b* which are upwardly extended respectively from opposite (right and left) side edges of the terminal bottom plate 3*a* and are bent inwardly to embrace the conductor 10 of the wire (to which the terminal 1 is to be connected) to thereby caulk the conductor 10 so that this conductor 10 is firmly attached to an upper surface of the terminal bottom plate 3*a*. The line-like groove 6 is formed on an inner surface of each conductor caulking piece 3*b*, and is disposed near to the distal end thereof, and this line-like groove 6 serves as a bend starting portion for inducing the distal end portion 3*c* of the conductor caulking piece 3*b* to be bent outwardly when the conductor caulking piece 3*b* is bent inwardly to embrace the conductor 10 as shown in FIG. 4.

The line-like groove 6 is a shallow straight groove formed in the conductor caulking piece in a pressing operation, and is formed in that portion of the inner surface of each conductor caulking piece 3*b* disposed near to the distal end thereof, and extends in the longitudinal direction of the press-clamping terminal 1. The line-like groove 6 may extend from the vicinity of one side edge of the conductor caulking piece 3*b* to the vicinity of the other side edge thereof spaced from the one side edge in the longitudinal direction of the press-clamping terminal 1 such that two non-groove portions 6*a* remain immediately adjacent respectively to the opposite ends of the line-like groove 6, as shown in FIG. 3A. Alternatively, the line-like groove 6 may extend continuously from the one side edge of the conductor caulking piece 3*b* to the other side edge thereof as shown in FIG. 3B.

Three serrations (grooves) 5 are formed in the inner surface of the conductor press-clamping portion 3, and extend perpendicularly to the longitudinal direction of the press-clamping terminal 1, and are spaced from one another in the longitudinal direction of the press-clamping terminal 1, each groove 5 being formed in the terminal bottom plate 3*a* and extending to the vicinities of the distal end portions 3*c* (that is, to the vicinities of the line-like grooves 6) of the two conductor caulking pieces 3*b*.

When the press-clamping terminal 1 of this construction is to be press-clamped or fixed, for example, to an aluminum wire as in this embodiment, first, an insulating sheath is removed from one end portion of the wire, thereby exposing a conductor made of aluminum (that is, a conductor including a bundle of aluminum wire elements often twisted together), and then the exposed conductor is placed on the terminal bottom plate 3*a* of the conductor press-clamping portion 3, and that portion of the sheath adjacent to the exposed conductor is located at the sheath caulking portion 4. Then, with the use of a press-clamping jig, the pair of conductor caulking pieces 3*b* are bent inwardly to embrace the conductor 10 to be caulked thereto as shown in FIG. 4, and by doing so, the conductor press-clamping portion 3 of the terminal 1 is press-clamped and hence connected to the conductor 10. At the same time, that portion of the sheath of the wire adjacent to the exposed conductor is caulked by the sheath caulking portion 4.

As described above, the line-like groove 6 serving as the bend starting portion is formed in the portion of the inner surface of each conductor caulking piece 3*b* disposed near to the distal end thereof, and therefore when the two conductor caulking pieces 3*b* are bent inwardly to embrace the conductor 10, the distal end portion 3*c* of each conductor caulking piece 3*b*, while piercing into the conductor 10, is bent outwardly at and along the line-like groove 6. Therefore, even when the conductor press-clamping portion 3 is excessively press-clamped to the conductor 10, the distal end portions 3*c* of the two conductor caulking pieces 3*b* are bent outwardly at the respective line-like grooves 6 away from each other in the direction of juxtaposition of the two conductor caulking pieces 3*b*, and bite into the conductor 10.

As a result, the following relation is established between the height Lh from the point P2 (lying on that portion of the distal end of each conductor caulking piece 3*b* which is the closest to the terminal bottom plate 3*a*) to the point P1 (lying on that portion of the area of overlapping of the outer surfaces of the two conductor caulking pieces 3*b* with each other which is the closest to the terminal bottom plate 3*a*) and the distance LW between the two points P2 lying respectively on the two conductor caulking pieces 3*b*.

$$Lh<Lw$$

Therefore, the bottoming of the distal end portions 3*c* of the conductor caulking pieces 3*b* as in the known structure can be prevented, and the fixing force is prevented from being reduced. In addition, the outwardly-bent distal end portions 3*c* of the conductor caulking pieces 3*b* bite laterally into the conductor 10, and serve as hooks, and therefore the spring-back of the conductor caulking pieces 3*b* of the terminal 1 is suppressed efficiently particularly when this terminal 1 is made of copper or a copper alloy. Furthermore, since the distal end portions 3*c* of the conductor caulking pieces 3*b* are bent outwardly, the outer surfaces of the distal end portions 3*c* of the conductor caulking pieces 3*b* press the conductor 10 against the terminal bottom plate 3*a*, and therefore the region (indicated by arrows in FIG. 4) where the contact load is larger can be increased, and this contributes to the reduction of the contact resistance.

Furthermore, in this embodiment, each bend starting portion is defined by the line-like groove 6 formed in the portion of the inner surface of the conductor caulking piece 3*b* disposed in the vicinity of the distal end thereof, and therefore the two line-like grooves 6 can be formed simultaneously when the serrations 5 are formed in the inner surface of the conductor press-clamping portion 3 by pressing, and therefore the processing burden hardly increases. Furthermore, the distal end portion 3*c* of each conductor caulking piece 3*b* can be bent at the line-like groove 6, and therefore it can be neatly bent, and there is no fear that the distal end portion 3*c* of each conductor caulking piece 3*b* may be ruptured or broken at the line-like groove 6.

In the case where the line-like groove 6 extends from the vicinity of the one side edge of each conductor caulking piece 3*b* to the vicinity of the other side edge thereof, with the non-groove portions 6*a* remaining immediately adjacent respectively to the opposite ends of the line-like groove 6 as shown in FIG. 3A, the bendability of the distal end portion 3*c* of each conductor caulking piece 3*b* can be adjusted by changing the ratio of the length of the line-like groove 6 to the combined lengths of the two non-groove portions 6*a*.

In the case where the line-like groove 6 extends continuously from the one side edge of each conductor caulking piece 3*b* to the other side edge thereof as shown in FIG. 3B, the distal end portion 3*b* of each conductor caulking piece 3*b* can be bent uniformly over its entire length from the one side edge to the other side edge.

The present invention is not limited to the above embodiments, and suitable modifications, improvements, etc., can be made. Furthermore, the material, shape, dimensions, number, disposition, etc., of each of the constituent elements of the above embodiment are arbitrary and are not limited in so far as the invention can be achieved.

For example, although the line-like groove 6 is formed in the inner surface of each conductor caulking piece 3*b*, this groove 6 may be formed in the outer surface of the conductor caulking piece 3*b*. Furthermore, instead of the line-like groove 6, means for inducing the bending may be provided as the bend starting portion.

In the above embodiment, although the conductor press-clamping portion 3 of the press-clamping terminal 1 is press-clamped to the aluminum wire having the aluminum conductor 10, the press-clamping terminal and the press-clamping structure of the invention can be applied also to the case where the press-clamping terminal is press-clamped to any other suitable wire such as a copper wire having a conductor made of copper or a copper alloy.

In the present invention, even when the conductor 10 of the aluminum wire is made of an aluminum alloy, advantages similar to the above-mentioned advantages can be achieved. One specific preferred example of such aluminum alloy is an alloy of aluminum and iron. This alloy can be more easily stretched and has a higher strength (particularly a tensile strength) as compared with an aluminum conductor.

What is claimed is:

1. A press-clamping structure, comprising:

a wire which has a conductor therein; and a press-clamping terminal which includes a conductor press-clamping portion having a generally U-shaped cross-section wherein the conductor press-clamping portion includes a bottom plate and a pair of conductor caulking pieces which are upwardly extended respectively from opposite side edges of the bottom plate and are bent inwardly to embrace the conductor of the wire and caulk the conductor so that the conductor is firmly attached to an upper surface of the bottom plate, wherein the conductor press-clamping portion is press-clamped to the conductor of the wire to be electrically connected thereto, wherein the conductor caulking pieces are bent inwardly while outer surfaces of the conductor caulking pieces are partially contacted with each other, wherein distal end portions of the conductor caulking pieces are disposed in a vicinity of the bottom plate, and are bent outwardly in a opposite direction to each other while piercing into the conductor of the wire, and wherein when P1 represents a point closest to the bottom plate on an area in which the outer surfaces of the conductor caulking pieces are contacted with each other, and P2 represents a point closest to the bottom plate on the distal end portion of each of the conductor caulking piece, a formula Lh<Lw is established where Lh represents a height from the point P2 to the point P1 in a direction perpendicular to the bottom plate, and Lw represents a distance between the points P2 lying respectively on the conductor caulking pieces.

2. The press-clamping structure according to claim 1, wherein a bend starting portion is formed on an inner surface or an outer surface of each of the conductor caulking pieces in a vicinity of the distal end portion thereof, and wherein the distal end portion of each of the conductor caulking piece is bent outwardly along the bend starting portion while piercing into the conductor so that the formula is established.

3. The press-clamping structure according to claim 2, wherein the bend starting portion is a straight groove formed on the inner surface of each of the conductor caulking pieces in a vicinity of the distal end portion thereof to be extended in a longitudinal direction of the press-clamping terminal.

4. The press-clamping structure according to claim 3, wherein the groove extends continuously from one side edge of the conductor caulking piece to the other side edge thereof spaced from the one side edge in the longitudinal direction of the press-clamping terminal.

5. The press-clamping structure according to claim 3, wherein the groove extends from a vicinity of one side edge of the conductor caulking piece to a vicinity of the other side edge thereof, spaced from the one side edge in the longitudinal direction of the press-clamping terminal, so that a non-groove portion remains between one end of the groove and the one side edge of the conductor caulking piece, while another non-groove portion remains between the other end of the groove and the other side edge of the conductor caulking piece.

6. The press-clamping structure according to claim 1, wherein the wire is an aluminum wire having therein the conductor made of aluminum or an aluminum alloy.

7. A press-clamping terminal comprising:

a conductor press-clamping portion which has a generally U-shaped cross-section, and includes a bottom plate and a pair of conductor caulking pieces which are upwardly extended respectively from opposite side edges of the bottom plate and are bent inwardly to embrace a conductor of a wire to thereby caulk the conductor so that the conductor is firmly attached to an upper surface of the bottom plate; and a bend starting portion formed on an inner surface or an outer surface of each of the conductor caulking pieces in a vicinity of a distal end thereof, wherein when each conductor caulking piece is bent inwardly to embrace the conductor, the distal end portion of each conductor caulking piece, while piercing into the conductor, is bent outwardly along the bend starting portion, wherein the bend starting portion is a substantially straight groove formed on the inner surface of each of the conductor caulking pieces in a vicinity of the distal end portion thereof to be extended in a longitudinal direction of the press-clamping terminal, and wherein the groove extends from a vicinity of one side edge of the conductor caulking piece to a vicinity of the other side edge thereof, spaced from the one side edge in the longitudinal direction of the press-clamping terminal, so that a non-groove portion remains between one end of the groove and the one side edge of the conductor caulking piece, while another non-groove portion remains between the other end of the groove and the other side edge of the conductor caulking piece.

* * * * *